US008957337B2

(12) United States Patent
Niu

(10) Patent No.: US 8,957,337 B2
(45) Date of Patent: Feb. 17, 2015

(54) RIGID KEYBOARD MECHANISM

(75) Inventor: James J. Niu, San Jose, CA (US)

(73) Assignee: Apple Inc., Cupertino, CA (US)

( * ) Notice: Subject to any disclaimer, the term of this patent is extended or adjusted under 35 U.S.C. 154(b) by 268 days.

(21) Appl. No.: 13/407,910

(22) Filed: Feb. 29, 2012

(65) Prior Publication Data

US 2013/0220786 A1 Aug. 29, 2013

(51) Int. Cl.
*H01H 13/70* (2006.01)

(52) U.S. Cl.
USPC ..... 200/344; 200/5 A

(58) Field of Classification Search
USPC ..... 200/341; 400/495
See application file for complete search history.

(56) References Cited

U.S. PATENT DOCUMENTS

| | | | | |
|---|---|---|---|---|
| 5,278,371 | A | 1/1994 | Watanabe et al. | |
| 5,746,308 | A | 5/1998 | Lin | |
| 5,986,227 | A | 11/1999 | Hon | |
| 5,997,196 | A * | 12/1999 | Hu | 400/495 |
| 6,040,540 | A * | 3/2000 | Tsai et al. | 200/344 |
| 7,460,050 | B2 | 12/2008 | Alvarado et al. | |
| 7,842,895 | B2 * | 11/2010 | Lee | 200/344 |
| 8,207,872 | B2 | 6/2012 | Huang et al. | |
| 8,446,264 | B2 | 5/2013 | Tanase | |
| 2011/0155552 | A1 | 6/2011 | Wang | |
| 2011/0260978 | A1 | 10/2011 | Larsen | |
| 2013/0161171 | A1 | 6/2013 | Leong et al. | |
| 2013/0161172 | A1 | 6/2013 | Leong et al. | |
| 2013/0162450 | A1 | 6/2013 | Leong et al. | |

FOREIGN PATENT DOCUMENTS

| | | |
|---|---|---|
| WO | WO 99/024962 | 5/1999 |

* cited by examiner

*Primary Examiner* — Renee S Luebke
*Assistant Examiner* — Ahmed Saeed
(74) *Attorney, Agent, or Firm* — Brownstein Hyatt Farber Schreck, LLP

(57) ABSTRACT

A keyboard for an electronic device, including a switch plate configured to be in communication with the electronic device, a key cap movably supported above the switch plate, and a translation mechanism operably connected to the switch plate and the keycap. The translation mechanism is configured to translate the key cap vertically relative to the switch plate. The translation mechanism includes a first support and a second support substantially identical to the first support, where the first support and the second support are a rigid material and as the key cap is depressed, the first support and the second support pivot relative to each other to translate the keycap vertically with respect to the switch plate.

15 Claims, 17 Drawing Sheets

RIGID KEYBOARD MECHANISM

TECHNICAL FIELD

The present invention relates generally to electronic devices, and more specifically to input devices for electronic devices.

BACKGROUND

Computers and other electronic devices typically include one or more input devices, such as mice, keyboards, joysticks, and the like so a user can more easily interact with the device in question. Often, these input devices may be integrated with or into the associated electronic device. For example, a laptop computer may include a keyboard operably connected to its internal systems and housed within its enclosure.

Typical keyboards may include a scissor mechanism to translate a keycap vertically. Conventionally, scissor mechanisms may be formed out of plastic so that they can be snapped into place during assembly of the keyboard. However, due the inherently compliant nature of plastic, keys supported by plastic scissor mechanisms may have different force-displacement characteristics at a center of a keycap and a corner of the keycap. As one example, if a user presses the corner of the keycap, the keycap may bend or torque about the scissor mechanism rather than move downwards. Further, in some large keycaps, such as a spacebar, a plastic scissor mechanism may require a link bar to assist in transferring a force from the edge of a key to the center of the key, so that a force applied to an edge of the keycap may act to depress the key and thus activate an input switch located beneath a middle of the keycap.

SUMMARY

Some embodiments of the present disclosure may take the form of a keyboard for an electronic device including a switch plate configured to be in communication with the electronic device, a key cap movably supported above the switch plate, and a translation mechanism operably connected to the switch plate and the keycap. The translation mechanism is configured to translate the keycap vertically relative to the switch plate. The translation mechanism includes a first support and a second support substantially identical to the first support, where the first support and the second support are both a rigid material, and as the keycap is depressed, the first support and the second support pivot relative to each other to translate the keycap vertically with respect to the switch plate.

Other embodiments may take the form of a scissor mechanism for a keyboard. The scissor mechanism includes a first support and a second support, where the first support and the second support translate a keycap vertically with respect to a base. The first support includes a first leg defining a first pivoting aperture, a first anchoring member extending from a first end of the first leg, a second leg operably connected to the first leg, and a rotation member extending from an inner surface of the second leg. The second support includes a third leg defining a second pivoting aperture, a second anchoring member extending from a first end of the third leg, a fourth leg operably connected to the third leg, and a rotation member extending from an inner surface of the fourth leg.

Still other embodiments may take the form of a method for assembling a keyboard. The method includes providing a pair of substantially identical support members, where each support member includes a first leg defining a pivoting aperture, at least one anchoring member, a second leg operably connected to the first leg, and a rotation member extending from an inner surface of the second leg; inserting the rotation member of each support into the pivoting aperture of the other support; positioning the first leg of one support adjacent to and substantially touching the second leg of the other support; operably connecting the at least one anchoring member to a base; and spacing the first leg of one support away from the second leg of the other support by a spacing distance

SPECIFICATION

Overview

Figure 1:
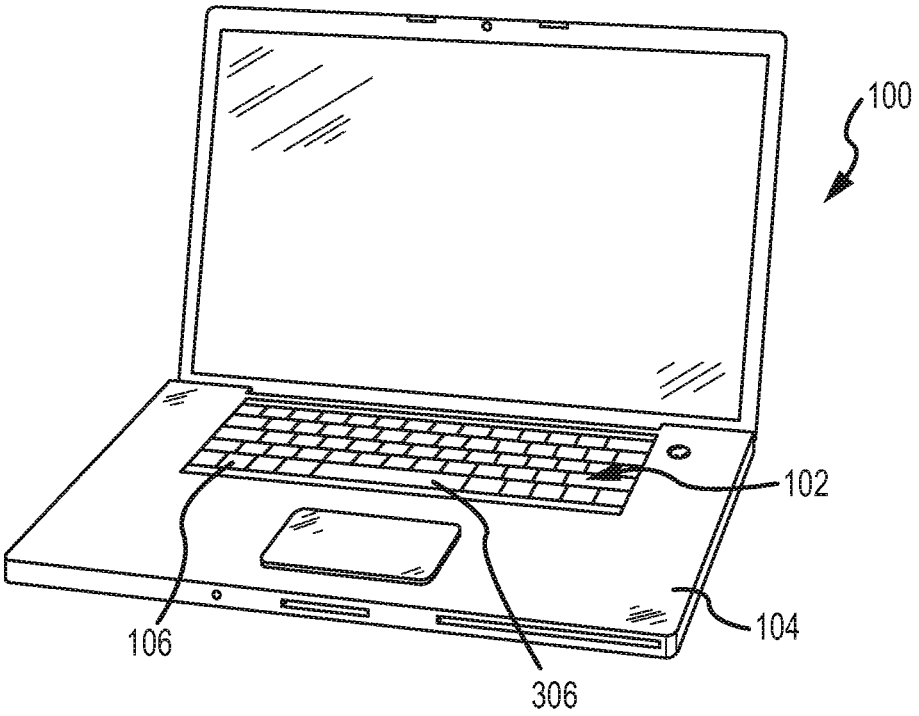
FIG. 1 is a perspective view of an electronic device including a keyboard.

Some embodiments described herein may take the form of keyboard for an electronic device. The keyboard may be integrated into an electronic device, such as a laptop, or may be separate from the electronic device, but be in communication with the electronic device through either a wired or wireless connection. The keyboard may include a plurality of keys that may be pressed, touched, or otherwise selected by a user to provide input to the electronic device. Each key may include a key stack that may include a switch circuit or feature plate, a switch device or mechanism, and a base plate. Additionally, the key stack may further include a keycap and a translation or scissor mechanism for supporting and assisting the key in transitioning between an extended or normal position and a compressed or selected position.

In some embodiments the translation mechanism may be a made of a relatively stiff material, such as metal, metal alloys, composite materials, or the like. The translation mechanism may be stiffer or made more rigid as compared to conventional scissor mechanisms, and this may reduce or eliminate the need for a link bar in the key stack. This is because the increased rigidity may provide a more consistent force-displacement characteristic. A force-displacement characteristic may generally define the displacement of one or more components of the key in response to a force. In other words, as a force is applied to a certain portion or component of the key, the force-displacement characteristic may define how other components or portions of the key may move or displace relative to the force. In the translation mechanism of the present disclosure, a force applied to the corner of the keycap may result in approximately the same movement of the keycap (due to the translation mechanism) as a force applied to the center of the keycap. Further, any force on an edge of the keycap may be transmitted to a center of the keycap, which may allow a dome switch or other input switch to be selected, although the force may be spatially separated therefrom. Thus, the keyboard of the present disclosure may facilitate a keyboard requiring fewer components, which may reduced the cost and/or complexity of manufacturing a keyboard.

Conventional scissor mechanisms for keyboards may be constructed out of plastic in order to allow for the scissor mechanisms to be snap-fit onto a base of the keyboard. However, the plastic material may break or deform due to torsion. Hence, in these type of keyboards if a user presses on an edge of a key, the force may cause the plastic material to bend at an edge or hinge, thus bending or twisting the keycap. Alternatively, the plastic scissor mechanism may break. Either failure may prevent the key from registering an input and/or may cause the key to have a varied force-displacement characteristic such that the location of the force may determine the displacement of the key (vertically and/or horizontally).

Additionally, the translation mechanism may be configured so as to not require deformation in order to be assembled within the key stack. Conventional keys, and specifically plastic scissor mechanisms, may generally "snap-fit" into position within the base, which may require that the scissor mechanism be able to deform in order to be snapped into place. Thus, in many instances, conventional scissor mechanisms are made of plastic. In the current embodiment, the translation mechanism may be configured to allow the supports to be slid into place, and thus deformation of the scissor mechanism may not be required. In this manner, the rigidity of the translation mechanism may be increased without adding complexity to the assembly process for the keyboard. The design of conventional scissor mechanisms may prevent the components from being made of a rigid material, as the rigidity may prevent the components from being assembled together in a "snap-fit" manner.

The translation mechanism may further include two supports, with each support having two anchoring members for securing the supports to the base. The two supports may be operably connected to each other by a sliding center pivot joint. The anchoring members may operably connect the translation mechanism to the base such that the translation mechanism may be substantially immovably secured to the base or other component of the key stack. The sliding center pivot may allow vertical motion of the keycap, even through the translation mechanism may be substantially prevented from laterally moving relative to the base. The one or more anchoring or restraining members may provide movement control to restrain lateral movement of the translation mechanism. The translation mechanism may further include a movement extension member that may provide precision vertical height control as it may act as a limit to restrain upward vertical movement of the translation mechanism.

A keyboard in accordance with a sample embodiment will now be discussed in more detail. FIG. 1 is a perspective view of a computing device 100 having a keyboard 102 incorporated therein. The computing device 100 may be substantially any type of computing device 100, such as a laptop computer, desktop computer, smart phone, portable gaming device, and so on. Additionally, it should be noted that although the keyboard 102 is illustrated in FIG. 1 as being integrated with the computing device 100, in other embodiments, the keyboard 102 may be separate from the computing 100. For example, the keyboard 102 may be a standalone unit and substantially self contained. In these embodiments, the keyboard 102 may include a communication device (e.g., cable, wireless interface) for transferring data to and from the computing device 100.

In some embodiments, the computing device 100 may further include an enclosure 104 substantially surrounding the keyboard 102. In embodiments where the keyboard may be physically separate from the computing device, the enclosure 104 may at least partially surround the keyboard 102 and may be operably connected to the keyboard 102. In some embodiments, the enclosure 104 may define multiple apertures, each of which may receive one or more keys 106 of the keyboard 102. However, in other embodiments, the enclosure 104 may define a single aperture or fewer apertures than the number of keys, so that the entire keyboard 102 may be received within a single aperture or groups of keys may be received through group apertures.

The keyboard 102 may include multiple keys 106 of varying sizes and/or shapes. Additionally, each of the keys 106 may include a symbol or indicator on a top surface of a keycap. For example, the symbol (not shown) for each key 106 may be painted, etched, or illuminated through a keycap through an aperture or transparent portion. Each of the keys 106 may represent one or more different inputs, and as each key 106 is depressed by a user, the key 106 may provide an input to the computing device 100. For example, the keys 106 may include a sensor to detect when it is depressed, and the sensor may transmit a signal to a processor within the computing device 100 indicating that the key 106 has been depressed or otherwise selected. In other embodiments, as the key 106 is depressed, it may complete a switch circuit indicating that the key has been selected.

Figure 2:
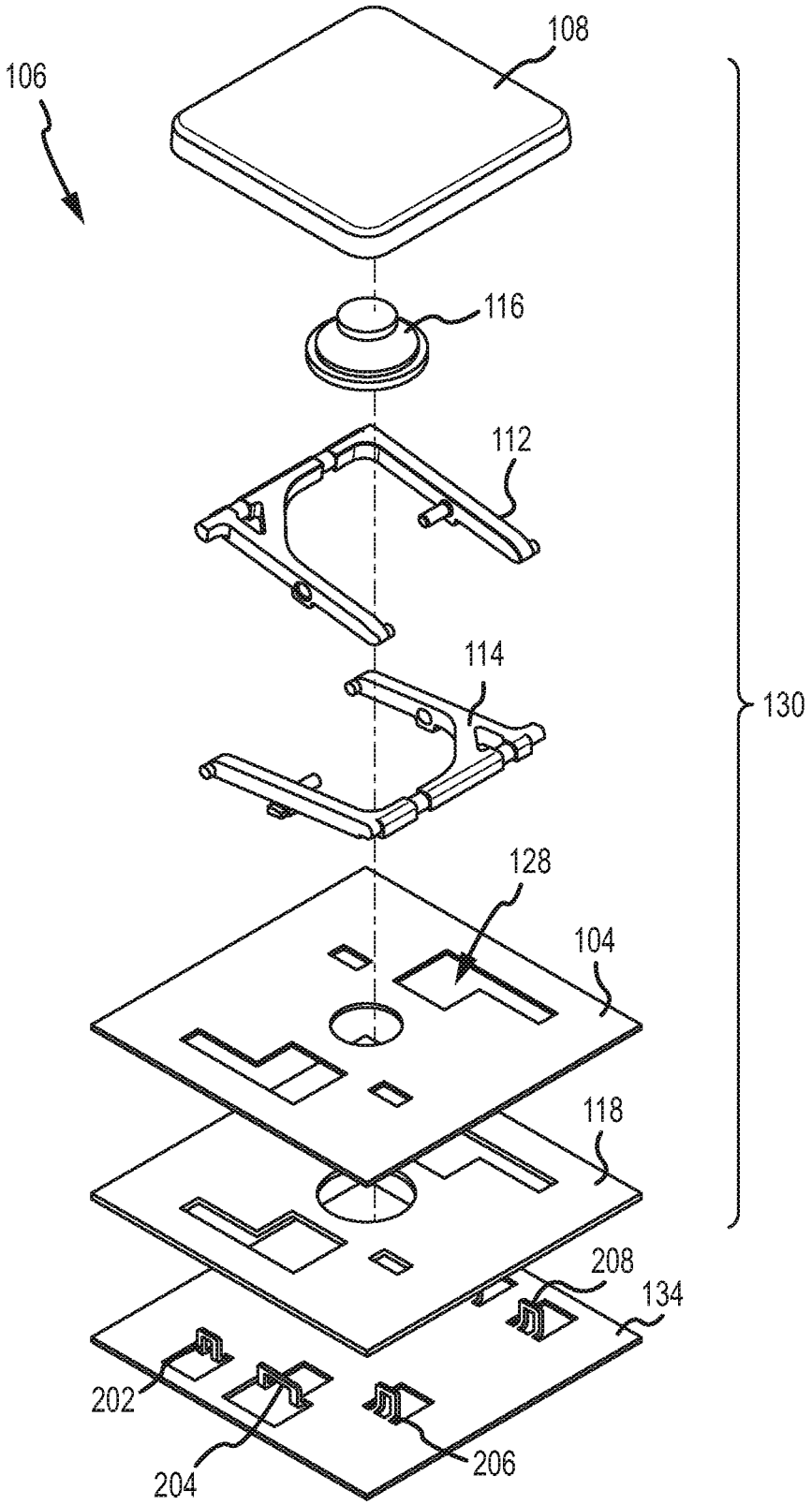
FIG. 2 is an exploded view of a key of the keyboard.

The keys 106 of the keyboard 102 will now be discussed in more detail. FIG. 2 is an exploded view of the key 106 illustrating the components of the key stack 130. The key 106 may include a keycap 108 supported by a translation mechanism 110, support mechanism, or scissor mechanism. The translation mechanism 110 supports the keycap 108 over a base 134 with a switch device 116 positioned within a cavity (see FIG. 3B) defined by the translation mechanism 110 and below the keycap 108 and configured to communicate with a switch plate 118.

The translation mechanism 110 may be, for example, a scissor mechanism or support mechanism and is discussed in more detail below. Briefly, the translation mechanism 110 may include a first support 112 and a second support 114, both of which may be operably connected to the base 134. The supports 112, 114 cooperate to translate the keycap 108 vertically within the key aperture 128 in response to a downward force on the keycap 108. In some embodiments, the translation mechanism 110 may be operably connected to a bottom surface of the keycap 108, so that as a force is exerted on the keycap 108, that force is transferred to the translation mechanism 110. Additionally, the translation mechanism 110 may attach to the base 134 by one more anchoring or restraining members 202, 204, 206, 208, 210, 212 that affix the support mechanism 110 to the base 134. Thus, the first and second supports 112, 114 may move vertically, but may be substantially prevented or (in some embodiments) partially limited from moving laterally.

The switch device 116 may be substantially any type of device capable of indicating an input or selection of the key 106. Additionally, in some instances the switch device 116 may also provide feedback to a user in response to the user touching and/or applying a force to the key 106. In one embodiment, the switch device 116 is a compressible dome that may be bonded or otherwise connected to one or more layers of the base 134. For example, the dome may mechanically compress as the user provides a downward force on the keycap 116, providing feedback to the user. In this example, as the dome compresses, the flex or buckling of the dome is felt by the user to provide feedback. The switch device 116 is also be communicatively coupled to the switch plate 118, so that as the switch device 116 is compressed with the keycap 108 it may provides an selection input signal to indicate that the key 106 has been pressed. For example, the switch device 11 may include a contact on the inner surface of the dome or other component and as the keycap 108 is compressed, the contact is placed into contact with the switch plate 118 to complete a circuit, switch, or otherwise register an input. In other embodiments, a separate mechanism, such as a mechanical or electrical switch may be operably connected to the translation mechanism 110 and/or keycap 108 to provide an input indicating when the key 106 has been selected.

With continued reference to FIG. 2, the base 134 may be operably connected to the enclosure 104 through a fastener or adhesive (not shown) or may be operably connected by the translation mechanism 110. In some embodiments, as the key 106 is operably connected to the base 134 (through the translation mechanism 110 and/or the switch device 116), the base 134 may operably connect the key 106 to the enclosure 104. It should also be noted that in other embodiments, the enclosure 104 may be omitted and the key 106 may include the base 134 and the switch plate 118, where the base 134 and switch plate 118 may act to protect internal components of the keyboard 102.

The base 134 may include one or more anchoring features or features 202, 206, 208, 210 as well as one or more stopper features or features 204, 212. The anchoring features 202, 206, 208, 210 and the stopper features 204, 212 may each extend upwards from the base 134 and may each define a slot or receiving aperture. It should be noted that in other embodiments, the anchoring features 202, 206, 208, 210 and/or the stopper features 204, 212 may be replaced by one more other fastening mechanisms, such as apertures defined through a wall, adhesive, fasteners, or the like.

The anchoring features 202, 206, 208, 210 may be generally U or channel shaped, but may be operably connected to the base 134 so as to form a loop, receiving aperture or opening for a portion of the supports to be received therein. In other embodiments, the anchoring features 202, 206, 208, 210 may be partially enclosed, defining a "hook" rather than a "loop" or receiving aperture. The anchoring features or members 202, 206, 208, 210 may operably connect to one or more corresponding members on the supports 112, 114, as discussed in more detail below. The anchoring features 202, 206, 208, 210 may be positioned at discrete locations along the base 134. In some embodiments, two anchoring features 202, 208 may be positioned closer to the edge of the base 134 whereas two anchoring features 206, 210 may be positioned closer towards a middle portion of the base 134. However, the position of the anchoring features 206, 210 may be selected based on a desired anchoring location of the supports 112, 114.

The stopper features 204, 212 may be similar to the anchoring features 202, 206, 208, 210, but may be wider than the anchoring features 202, 206, 208, 210. Additionally, the stopper features 204, 212 may, as discussed in more detail below, allow the support members 112, 114 and the connecting members to move vertically therein. The anchoring members 202, 206, 208, 210 may substantially restrain portions of the support members 112, 114

A switch plate 118 may be sandwiched between the enclosure 104 and the base 134. Also, the switch plate 118 may communicatively connect the key 106 to the computing device 100. For example, the switch plate 118 may include contacts (not shown) for transmitting electrical signals so that, when the key 106 is selected by a user, an electronic signal is sent to the electronic device 100, thereby providing the user input to the device 100.

Figure 3A:
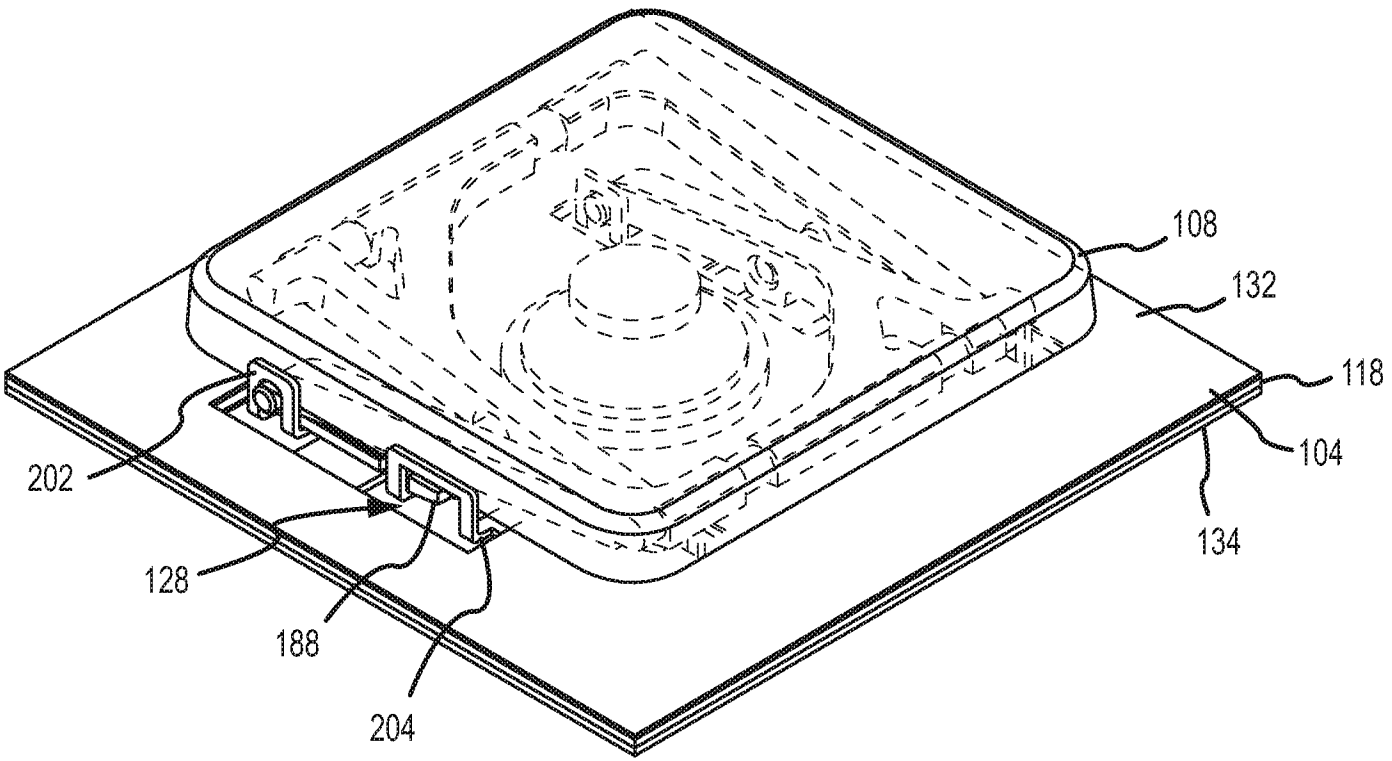
FIG. 3A is a top perspective view of an example of the key of the keyboard in an extended position.
Figure 3B:
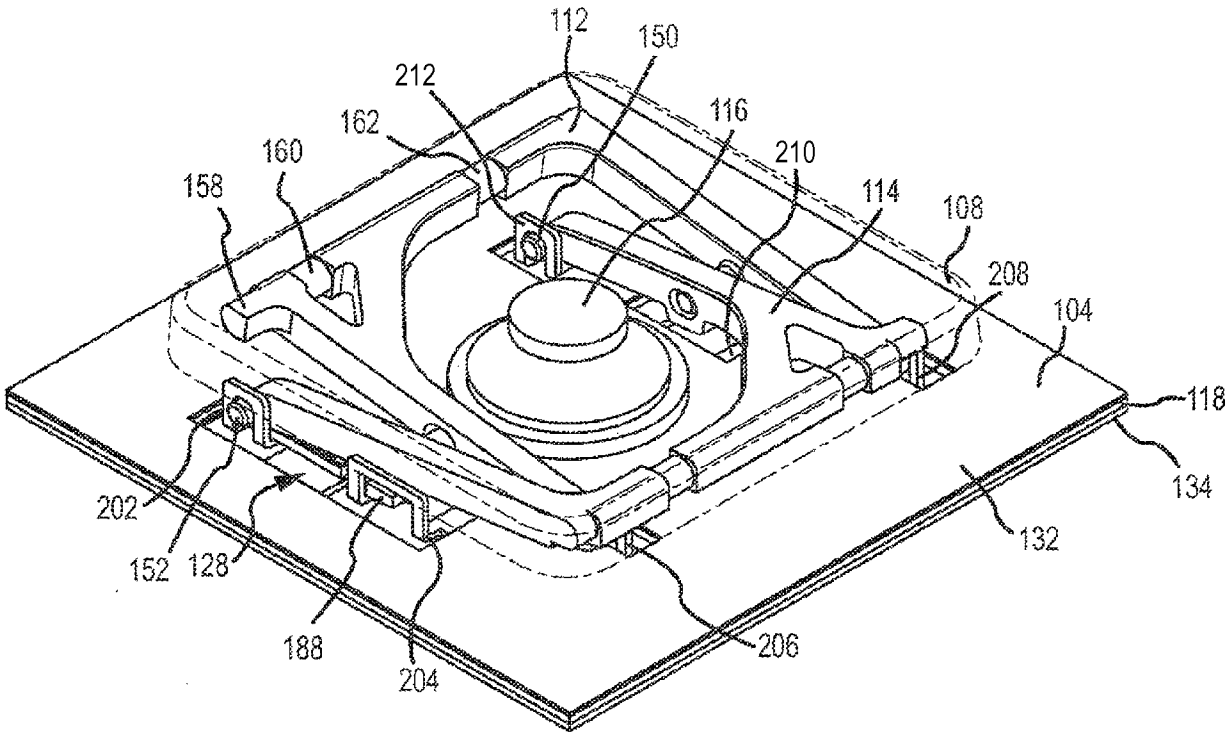
FIG. 3B is a top perspective view of the key with its keycap shown in phantom for clarity.
Figure 3C:
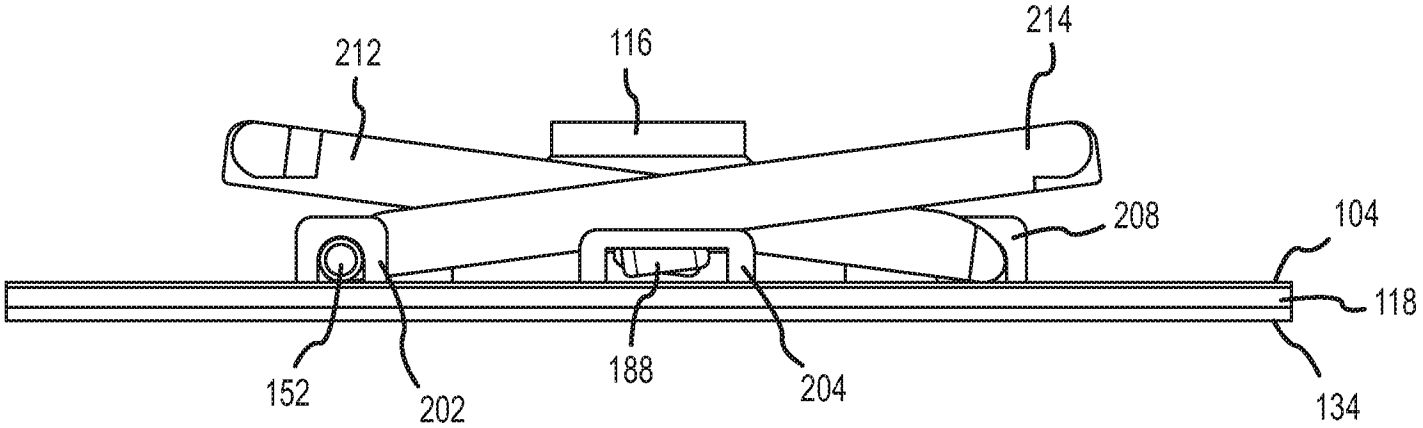
FIG. 3C is a side elevation view of the key of FIG. 3B.
Figure 4A:
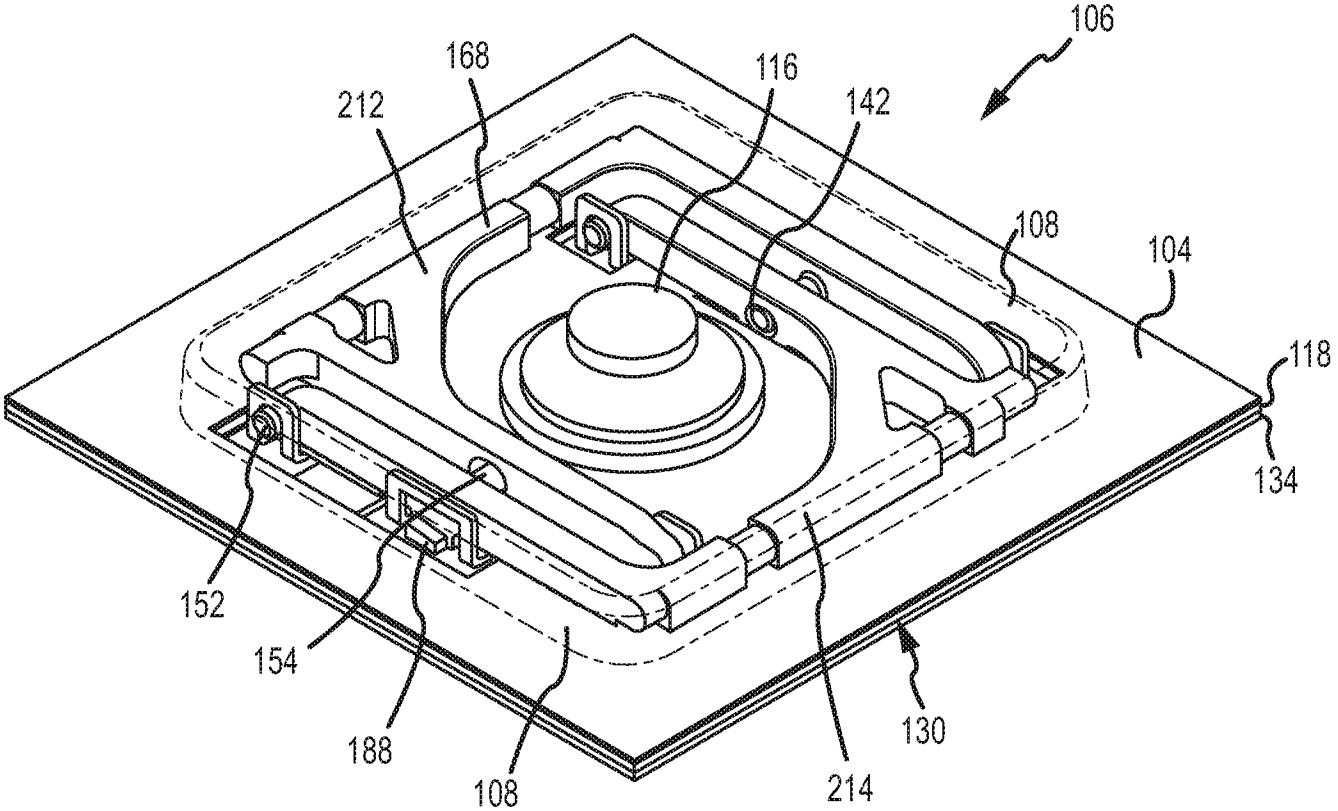
FIG. 4A is top perspective of the key of FIG. 3B with the key in a compressed position.
Figure 4B:
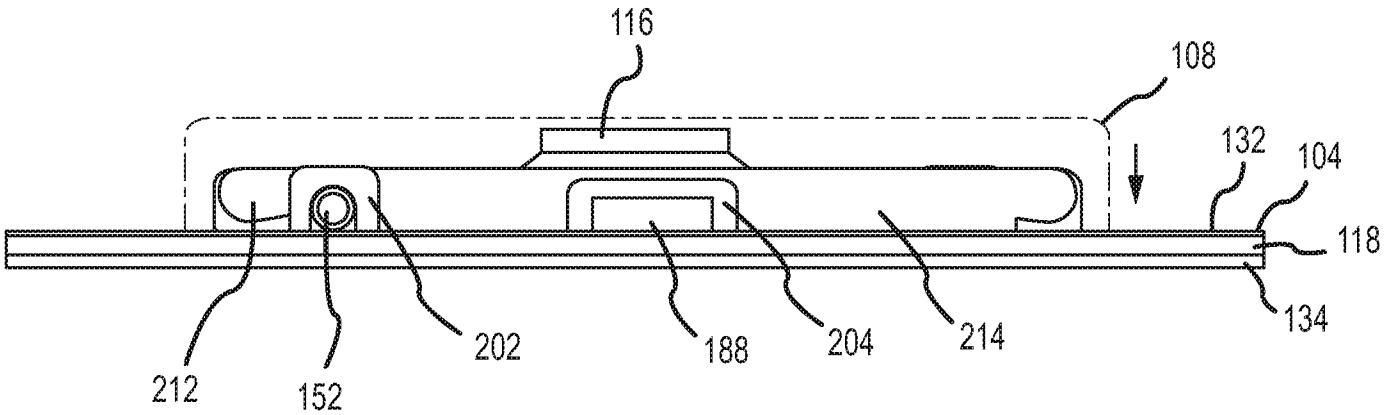
FIG. 4B is a side elevation view of the key of FIG. 4A.

As briefly described above, the enclosure 104 may define a key aperture 128 in which the key 106 is positioned. The enclosure 104 may also surround the key 106. Although, as noted above, in some instances, the enclosure 104 may form a portion of the device 100, but may not be a part of the keyboard 102 and/or key 106 . In these instances, the key 106 and/or keyboard 102 may not include the enclosure 104. FIG. 3A is a top perspective view of the key 106. FIG. 3B is a similar view of the key as FIG. 3A with the keycap shown in phantom to illustrate the key's translation mechanism and certain internal components. FIG. 3C is a side elevation view of the key of FIG. 3B. FIG. 4A is a top perspective view of the key in a compressed position. FIG. 4B is a side elevation view of the key of FIG. 4A. As shown in FIG. 3A, the key aperture 128 may be slightly larger than the key 106, so that the key 106 may move vertically within the key aperture 128. In some embodiments, the key 106 may have a resting or normal position where a keycap 108 may be positioned even with, lower with, or slightly higher than a top surface 132 of the enclosure 104. As a user depresses the key 106, the key 106 may translate downward, illustrated by the arrow in FIG. 3B, with respect to the top surface 132 of the enclosure 104.

Supports for the Translation Mechanism

Figure 5A:
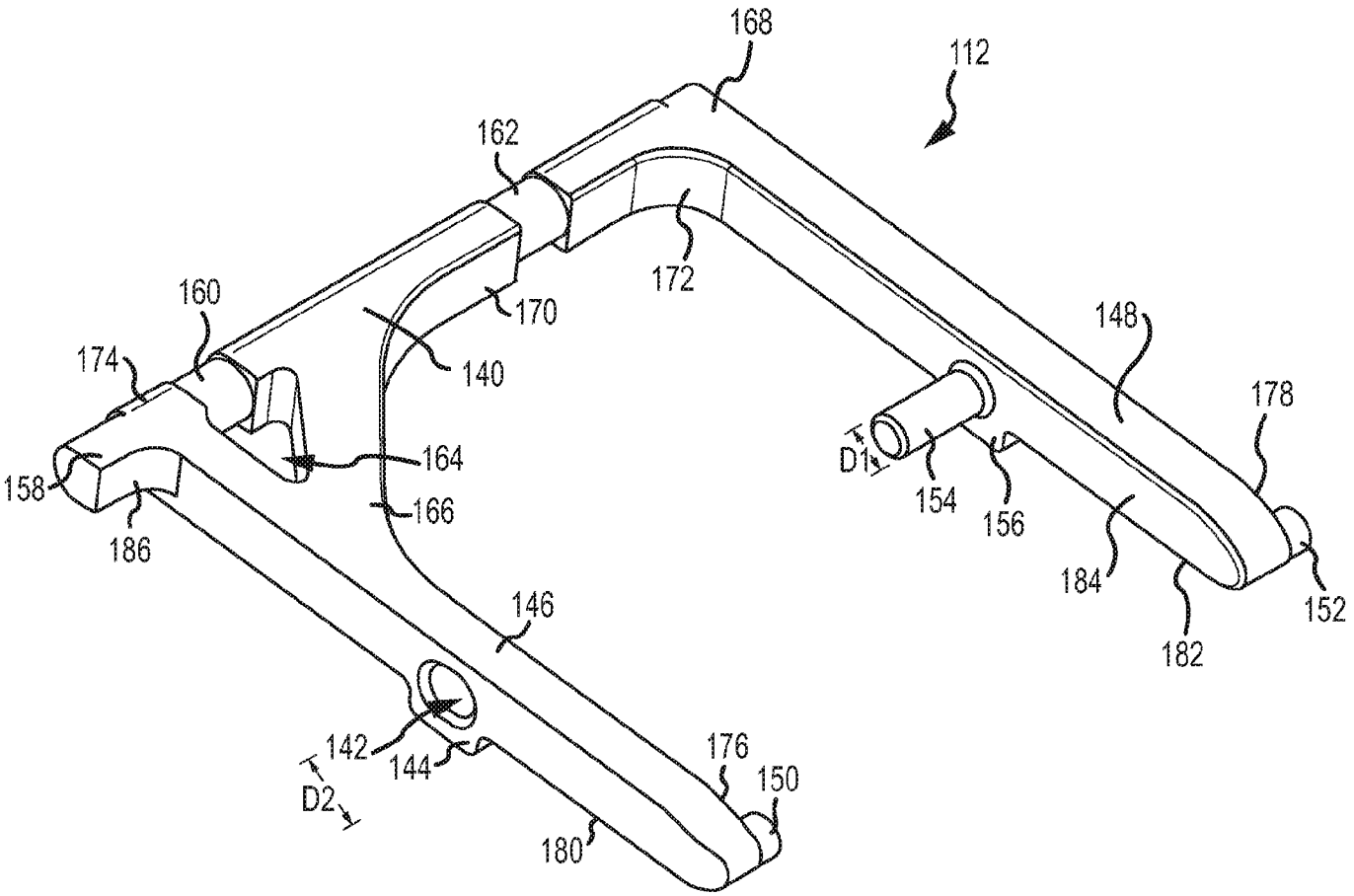
FIG. 5A is a top perspective view of a support of the key of FIG. 2.
Figure 5B:
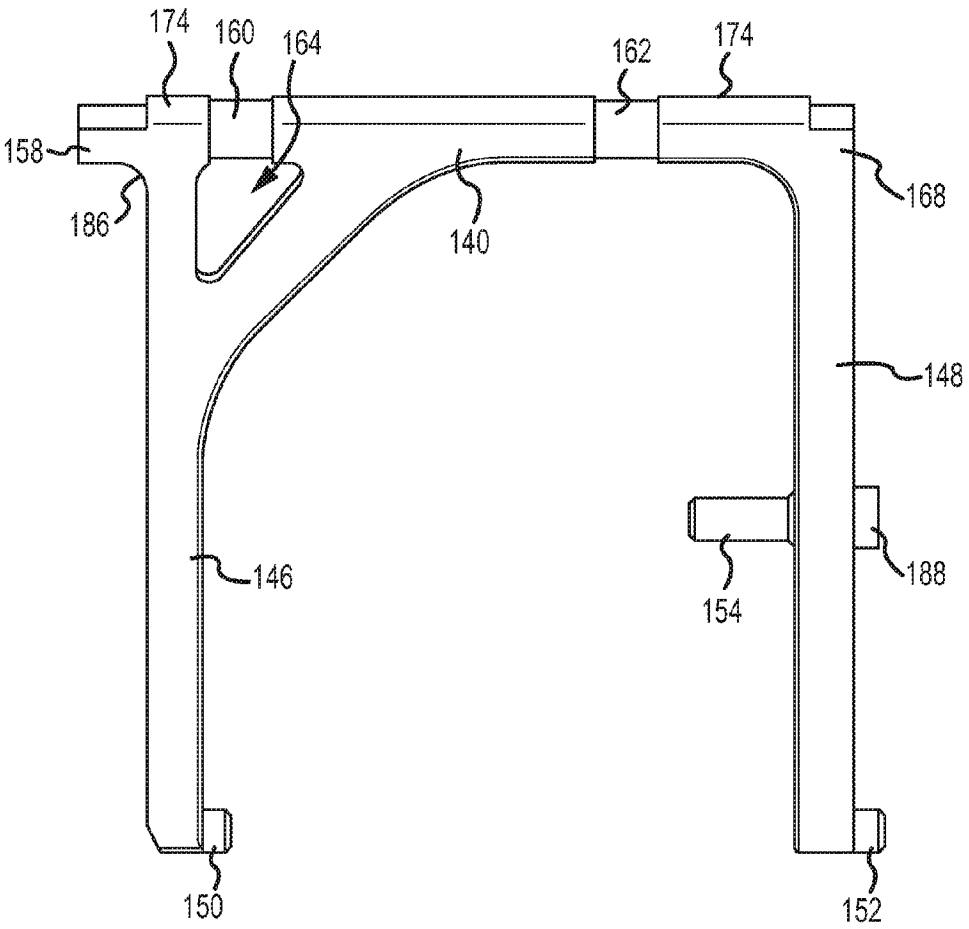
FIG. 5B is a top elevation view of the support of FIG. 5A.
Figure 5C:
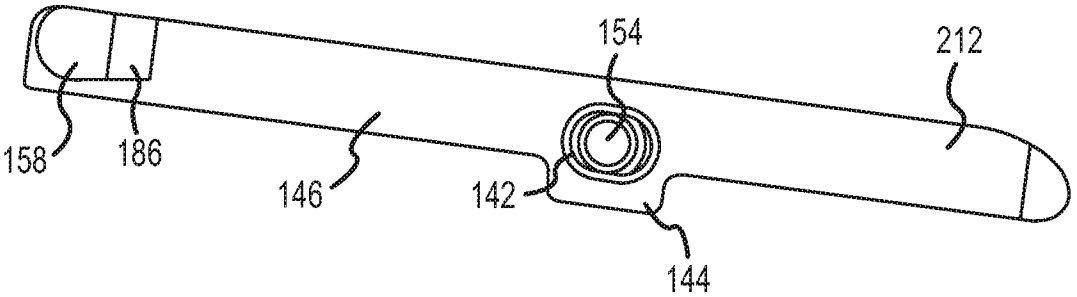
FIG. 5C is a side elevation view of the support of FIG. 5A.

The translation mechanism will now be discussed in more detail. FIG. 5A is an isometric view of the first support 112 or leg. FIG. 5B is a top plan view of the first support 112. FIG. 5C is a right side elevation view of the first support 112. It should be noted that in some embodiments, the first support 112 and the second support 114 may be substantially identical, and as such only the first support 112 is illustrated in FIGS. 5A-5C. When assembled to form the key stack 130, the first support 112 and the second support 114 may be positioned opposite one another, such that a right side of the first support 112 may be positioned adjacent with a left side of the second support 114 and vice versa.

The two supports 112, 114 may be made of a substantially rigid and/or non-deformable or deformable-resistant material, such as metal, metal alloy, or the like. In these embodiments, the supports 112, 114 may transfer force substantially equally across a length of the supports 112, 114, such that if a user compresses a side or edge of the keycap 108, the supports 112, 114 will extend downwards in substantially the same manner as when a user compresses a center of the keycap 108. Additionally, in some embodiments, the two supports 112, 114 may have substantially flat top and bottom surfaces. In these embodiments, the supports 112, 114 may be able to be rest substantially flat against the base 134, switch plate 118, or other component. In this manner, the height of the key stack 130 may be reduced when the key 106 is in the compressed position.

The support 112 may include a main body 140 having two legs 146, 148 spaced apart from one another and extending from the main body 140. The legs 146, 148 may be substantially the same length as each other and may extend substantially parallel to each other from the main body 140. In this manner, each leg 146, 148 may extend from an end of the main body 140, to form generally a U or trough shape for the support 112. In some embodiments, a top surface of each of the legs 146, 148 may be substantially flat and a bottom surface 180 may be substantially flat, except for the two protrusions 144, 156.

The legs 146, 148 may each include a securing or anchoring member 150, 152 that may extend from a right side surface 176, 178 at a terminal end of the legs 146, 148. In other words, the anchoring member 150 of the first leg 146 may extend towards the second leg 148, and the anchoring member 152 of the second leg 148 may extend away from the first leg 146. In this manner, both anchoring members 150, 152 may be oriented in the same direction.

The anchoring members 150, 152 secure the support 112 to the base 134 and will be discussed in more detail below. In some embodiments, the anchoring members 150, 152 may be pegs or other cylindrical shaped components that may permit rotation in a first direction, while still securing the support 112 in positioned in a second direction.

The first leg 146 may also include a pivoting aperture 142 defined therethrough. The pivoting aperture 142 may have a length dimension D2 and may be positioned at about a midpoint of the first leg 146. The pivoting aperture 142 in some embodiments may be oval shaped or circular shape. In other embodiments, the pivoting aperture 142 may be shaped and sized to generally correspond to a rotation member 154 of the second leg 148, discussed in more detail below. However, briefly, the length dimension D2 and shape of the pivoting aperture 142 may be configured to be larger than a diameter of the rotation member 154, for reasons that will be discussed in more detail below.

Beneath the pivoting aperture 142, the first leg 146 may include a protrusion or step 144 that may extend below a bottom surface 180 of the first leg 146. The protrusion 144 may provide additional strength to the leg 146, and specifically may locally strengthen the leg 146 at the location of the pivoting aperture 142. The protrusion 144 may be substantially aligned with the pivoting aperture 142 and may have a width that may be substantially similar to, or somewhat larger than, the length dimension D2 of the pivoting aperture 142.

With continued reference to FIG. 5A, the second leg 148 may include a rotation member 154 extending from an inner surface 184. The rotation member 154 may be oppositely oriented from the securing member 152, such that the securing member 152 may extend away from the first leg 146 whereas the rotation member 154 may extend towards the first leg 146. The rotation member 154 may be a peg or cylindrically shaped member and may be configured, as will be discussed in more detail below, to be received within the pivoting aperture 142 of the second support 114. FIG. 5C is a left side elevation view of the support 112. With reference to FIGS. 5A and 5C, the rotation member 154 may include a diameter D1 that may be smaller than the length dimension D2 of the pivoting aperture 142. Additionally, in some embodiments, the pivoting aperture 142 may be shaped as an elongated oval or a slot having rounded corners. For example, the pivoting aperture 142 may have a generally rectangular body but may have curved end portions. In these examples, as the pivoting aperture 142 may have generally rectangular slot having curved or rounded ends and the rotation member 154 may be circular shape, there may be a space between the rotation member 154 and the pivoting aperture 142 when the rotation member 154 is received into the pivoting aperture 142 of the opposite leg.

A movement extension 188 may extend from the right side surface 178 of the second leg 148 and may be substantially aligned with the rotation member 154. In some instances, the movement extension 188 may have a slightly wider dimension than the rotating member 154. The movement extension 188 may, along with the anchoring members 150, 152, help to secure the support 112 to the base 134. This is described in more detail below. Additionally, the movement extension 188 in cooperation with the stopper features 204, 212 may act as a limit or stop to define a maximum vertical upwards movement of the translation mechanism 110.

A second protrusion 156 may extend from a bottom surface 182 of the second leg 148. As with the first protrusion 144 of the first leg 146, the second protrusion 156 may be substantially aligned switch the rotation member 154 and may extend below the bottom surface 182. In some embodiments, the protrusion 156 may have a larger width that the diameter D1 of the rotation member 154, but the width may be substantially the same as the width of the first protrusion 144. Also similar to the first protrusion 144, the second protrusion 156 may provide additional structural strength to the leg 148 by increasing the material of the leg 148 at a select location, and specifically may increase the strength of the leg 148 locally around the rotation member 154.

The main body 140 may further include a cross member 168 that may extend substantially horizontally between the first leg 146 and the second leg 148. The cross-member 168 and main body 140 may also include relatively planar or flat top and bottom surfaces. In this manner, the surfaces that may be adjacent to the base 134, switch plate 118, and/keycap 108 may be relatively flat and not rounded or curved. The cross member 168 may have a generally rectangular or square shape in cross-section, and may include two recesses 160, 162 defined therein that may be substantially circular in cross-section. The two recesses 160, 162 may be spaced apart form each other and may be configured to be pivotably received within the keycap 108, discussed in more detail below. The cross member 168 may also include a lip 174 that may extend outwards towards from the cross member 168 away from the extension direction of the legs 146, 148.

As the main body 140 transitions from the second leg 148 to form the cross-member 168, the inner surface 184 may transition from a relatively straight surface to form a curved surface 172. After the curved surface 172, the inner surface may straighten to form an inner surface 170 of the cross-member 168. The inner surface 170 may be substantially planar, until the transition to the first leg 146, where the inner surface 170 may curve forming a shoulder 166.

The shoulder 166 or arch support may form a bridge between the cross member 168 and the first leg 146. In these instances, the shoulder 166 and the cross member 168 may define a shoulder aperture 164 defined by a top end of the first leg 146, the shoulder 166, and the cross member 168. The shoulder 166 may provide additional strength to the edge of the supports 112, 114. However, in some embodiments, the shoulder 166 and thus the shoulder aperture 164 may be omitted. For example, relatively small keys, such as letter keys may not require the additional structural support of the shoulder 166 whereas larger keys, such as a spacebar key, may benefit from the additional strength of the shoulder 166. Additionally, the shoulder 166 may be included if the material for the supports 112, 114 may have a reduced stiffness as compared to other embodiments, so that the force-displacement characteristics may be maintained, although the rigidity may be reduced.

The first leg 146 may extend past the connection to the shoulder 166 to connect with the cross-member 168 directly.

In these instances, the cross member 168 may be operably connected to the first leg 146 at a top proximal end of the first leg 146. An extension member 158 may extend from the intersection of the cross-member 168 and the first leg 146. The extension member 158 may be partially oval-shaped but may include a first side 186 that may transition from a relatively planar edge to curve in spanning between the extension member 158 and the first leg 146. The extension member 158 may engage a corner or other edge of the keycap 108, so that a force applied to the corner of the keycap 108 may be translated to the supports 112, 114.

The Translation Mechanism

The translation mechanism 110 includes both supports 112, 114 interconnected together. With reference again to FIGS. 3B and 4A, the first support 112 may be positioned along the base 134 and switch plate 118 so that the first leg 146 may be positioned adjacent the second leg 148 of the second support 114, such that the first leg 146 of the first support 112 may be positioned between the second leg 148 of the second support 114 and the switch device 116. Similarly, the first leg 146 of the second support 114 may be positioned adjacent the second leg 148 of the first support 146 and positioned between the second leg 148 of the first support 114 and the switch device 116. That is, the first leg 146 and the second leg 148 for each support 112, 114 may be positioned adjacent one another, with the second legs 148 of the first support 112 and the second support 114 positioned outside of the first legs 146 of the first support 112 and the second support 114. In this manner, the rotation member 154 of the second leg 148 of first support 112 may be received into the pivoting aperture 142 of the first leg 146 of the second support 112; and, the rotation member 154 of the second leg 148 of the second support 114 may be received into the pivoting aperture 142 of the first leg 146 of the first support 112.

The rotation members 154 may operably connect the two supports 112, 114 together, as well as provide a pivot point for allow the supports 112, 114 to rotate relative to each other. As briefly described above, the length dimension D2 of the pivot apertures 142 is larger than the diameter D1 of the rotation members 154, which allows the rotation member 154 to move within the pivot aperture 142. In some embodiments, the rotation member 154 may move laterally and vertically within the pivot aperture 142. Additionally, in some instances rotation member 154 may be substantially the only component of the translation mechanism 110 that may move laterally with respect to the base 134. For example, the anchoring members 150 152 may be secured to the base 134 to prevent the supports 112, 114 from moving laterally across the base 134, and so any lateral movement of the supports 112, 114 with respect to each other may be through the movement of the rotation member 154 within the pivoting aperture 142.

With continued reference to FIG. 3B, the anchoring members 150, 152 for the first support 112 and the second support 114 may be received into the anchoring features 202, 206, 208, 212 and may extend therethrough. For example, the anchoring member 150 of the first support 112 may be received into a second anchoring member 206, the anchoring member 152 of the first support 112 may be received into a third anchoring member 208, the anchoring member 150 of the second support 114 may be received into the first anchoring member 202 and the anchoring member 152 of the second support 114 may be received into the fourth anchoring member 212. In some embodiments, the anchoring members 150, 152 may be tightly received into the anchoring features 202, 206 so that the anchoring members 150, 152 may be substantially prevented from moving laterally and/or vertically relative to the base 134.

Each movement extension 188 may be received through one of the stopper features 204, 210. For example, the movement extension 188 of the first support 112 may be received through the second stopper feature 210 and the movement extension 188 of the second support 114 may be received through the first stopper feature 204. The movement extension 188 may have a reduced width and height as compared with the aperture defined by the stopper features 204, 210, so that the movement extension 188 may move within the stopper features 204, 210. In other words, unlike the anchoring members 150, 152, the movement extension 188 may move vertically with respect to the base 134.

The anchoring members 150, 152 and the movement extension 188 may be operably connected to the base 134, as described above, in order to secure the first support 112 and the second support 114 to the base 134. In some embodiments, the anchoring members 150, 152 when received within the anchoring features 202, 206, 208, 212, may substantially prevent lateral motion of the supports 112, 114 with respect to the base 134. The movement extensions 188 in combination with the stopper features 204, 210 may define a maximum movement of the supports 112, 114 in the vertical and/or lateral directions. In some embodiments, the movement extension 188 and the stopper features 204, 210 may set a maximum vertical distance that the supports 112, 114 may move relative to the base 134.

With reference to FIGS. 3A-3C, the recesses 160, 162 may be used to operably connect the supports 112, 114 to the keycap 108. For example, the keycap 108 may include one more receiving members that may snap fit or otherwise connect to the recesses 160, 162. In these examples, the keycap 108 may be a relatively flexible and/or deformable material that may be mated to the recesses 160, 162 in a snap fit manner. However, it should be noted that other connection mechanisms may be used to operably connect the keycap 108 to the supports 112, 114, such as but not limited to, adhesive, fasteners, or the like.

With reference to FIG. 3A, in the extended or normal position, the supports 112, 114 may be slightly angled with respect to one another, such that the legs 146, 148 may extend at a angle upwards from the anchoring members 150, 152 (that are secured by the anchoring features 202, 206, 208, 212 to the base 134). That is, from a side elevation view, such as shown in FIG. 3C, the supports 112, 114 may form a "X" shape. The cross-member 168 of each support may be substantially parallel to each other so that the keycap 108 may be supported so as to be substantially planar.

As briefly discussed above, the movement extension 188 may determine a maximum vertical translation for the supports 112, 114. For example, in a compressed position shown in FIG. 3B, the movement extension 188 may be positioned below a top bar of the stopper features 204, 210, and as the key 106 extends upwards, the movement extension 188 encounters the top bar of the stopper features 204, 210. The top bar may therefore prevent the upwards vertical movement of the movement extension 188, and thus supports 112, 114 limiting the upward vertical movement of the keycap 108.

The rotation members 154 act as a center pivot for the supports 112, 114. In this manner, in the "X" shape formed by the supports 112, 114 when viewed from a right or left side may form an "X" (see FIG. 3C), the rotation member 154 may form a center point or intersection of the "X." Because the rotation members 154 may move within the pivot apertures 142, due to the pivot apertures 142 having a larger length dimension than the rotation members 154, the rotation members 154 may provide vertical movement of the supports 112, 114 relative to each other.

With reference to FIG. 4A, as a force is applied to the keycap 108, such as by a user selecting a particular key 106, the supports 112, 114 may translate vertically and may pivot relative to each other. In the compressed position the supports 112, 114 may be oriented so that the legs 146, 148 of each support 112, 114 may be substantially parallel to each other. This is possible as the rotation members 154 may provide sufficient lateral translation (by a pivoting motion) to allow the legs 146, 148 of each support to sufficiently rotate to this orientation.

The rotation members 154 may provide vertical and/or horizontal or lateral movement for the supports 112, 114 relative to each other in the form of a sliding and/or pivoting motion. In other words, the rotation member 154 may slide within the pivoting aperture 142, since the pivoting aperture 142 has a longer length or dimension than the rotation member 154. Also, the rotation member 154 may move within the pivoting aperture 142, so the lateral movement may sufficiently allow the supports 112, 114 to move vertically without substantially lateral movement relative to one another, despite the angular "X" orientation.

With continued reference to FIG. 4A, as the supports 112, 114 rotate and translate vertically downwards towards the base 134, the keycap 108 may compress the switch device 116. The switch device 116 may then provide an input signal to the switch plate 118 to indicate that the key 106 has been pressed and/or provide feedback to the user.

Assembling the Keyboard

Figure 6A:
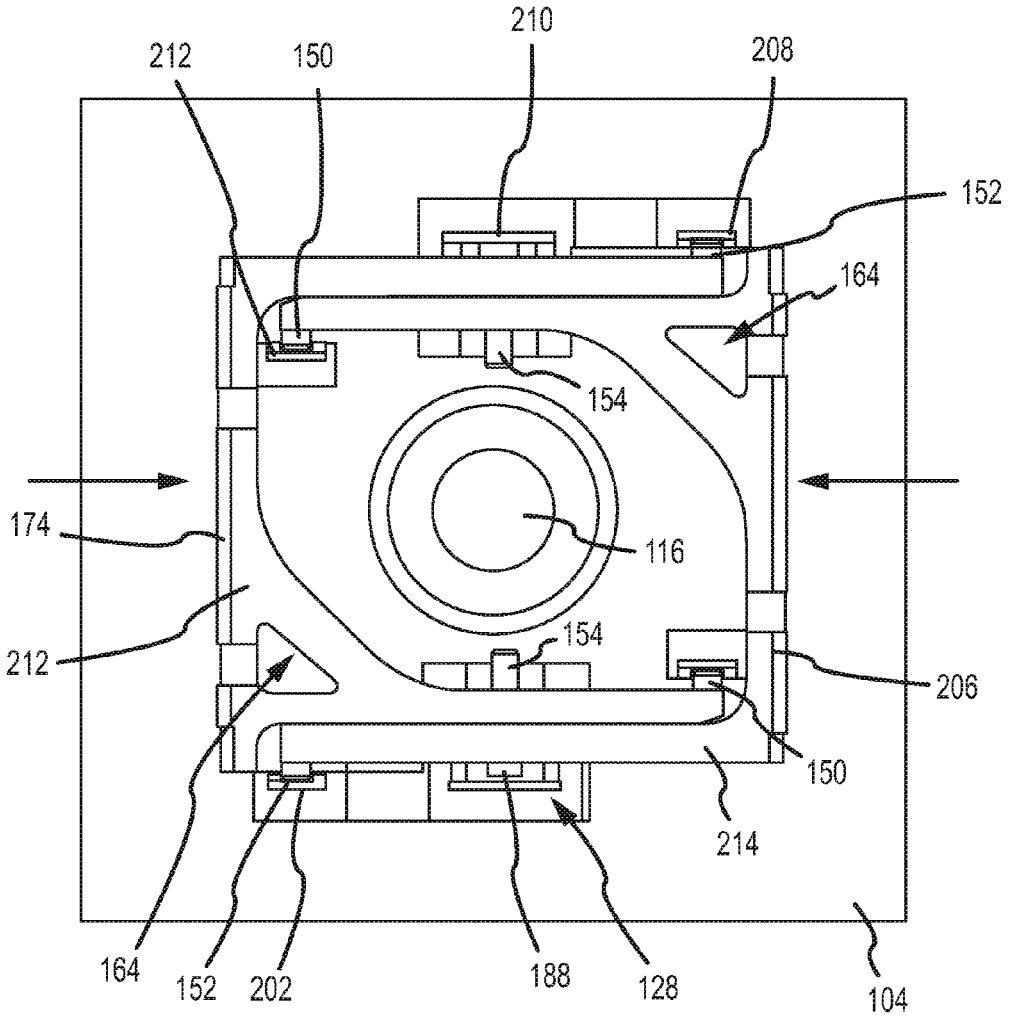
FIG. 6A is a top plan view of the key of FIG. 3A with the keycap removed and a translation mechanism in a first position.
Figure 6B:
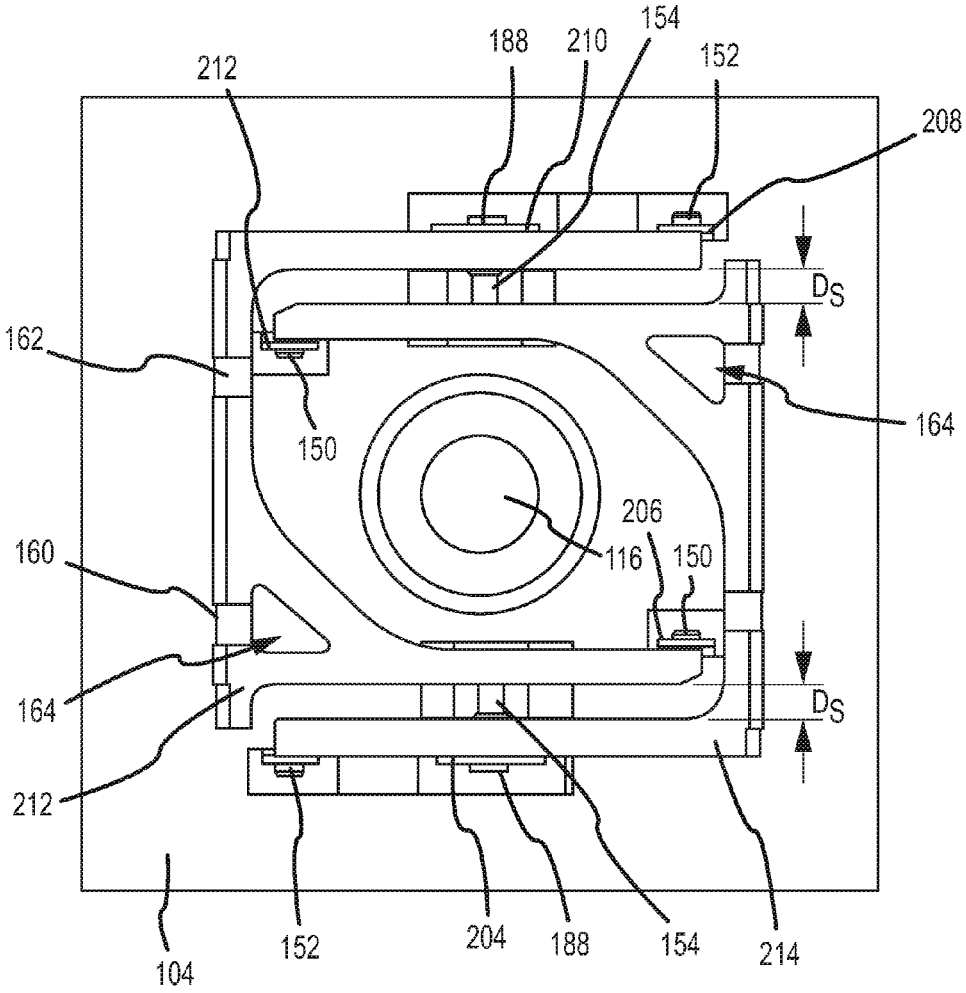
FIG. 6B is a top plan view of the key of FIG. 3A with the keycap removed and the translation mechanism in a second position.

The translation mechanism 110 may be configured to allow the keyboard 102 to be assembled relatively quickly, without requiring one or more components to be deformed in order to be secured into position. FIG. 6A is a top plan view of the key 106 with the keycap 108 removed and the translation mechanism in a first disassembled position. FIG. 6B is a top plan view of the key 106 with the keycap 108 removed, with the translation mechanism 110 being in a second assembled position. Initially, the two supports 112, 114 may be operably connected together. In some embodiments, one support 112, 114 may be rotated to approximately 90 degrees relative to the other support 112, 114. Once the two supports 112, 114 are angled with respect to one another, the rotation members 154 of each support 112, 114 may be inserted into the respective pivoting apertures 142 of each support 112, 114. The supports 112, 114 may then be rotated again to be substantially parallel with each other. The first support 112 may then be positioned on the base 134 between the anchoring features 202, 206, 208, 212 and the stopper features 204, 212 and the second support 114 may be positioned in a similar manner. In some embodiments, the legs 146, 148 of the two supports 112, 114 may be oriented so that the first leg 146 may be positioned between the switch device 116 and the second leg 148 of the other support 112, 114.

In a first position, the legs 146, 148 of the first support 112 and the second support 114 may be oriented so that they may be in contact with each other. That is, the first leg 146 of the first support 112 may be positioned adjacent to and in contact with (or substantially in contact with) the second leg 148 of the second support and the first leg 146 of the second support 114 may be positioned adjacent to and in contact (or substantially in contact with) with the second leg 148 of the first support 112. It should be noted that due to the relatively planar characteristic of the top and bottom surfaces of the supports 112, 114, the two supports 112, 114 may lay substantially parallel to the base 134 and switch plate 118.

In the first position, the anchoring members 150, 152 may be positioned near, but may not be received into, the anchoring features 202, 206, 208, 212. Similarly, the movement extension 188 may be positioned near but may not be received into the stopper features 204, 210. In this first position as shown in FIG. 6A, the supports 112, 114 may be slid horizontally onto the enclosure 104 or base 134 in the directions indicated by the arrows, to be aligned in position to be aligned with the respective features 202, 204, 206, 208, 210, 212.

Once the supports 112, 114 have been positioned as shown in FIG. 6A, the supports 112, 114 may be extended or pulled outwards away from the switch device 116 or center of the key 106. For example, a user may pull each support 112, 114 outwards or a machine such as a robot or other manufacturing device may be configured to apply the outwards force to the supports 112, 114. With reference to FIG. 6B, as they are pulled, the supports 112, 114 may be positioned in a second position with a spacing distance Ds between the first leg 146 of one support and the second leg 148 of another support. In other words, the first leg 146 of the first support 112 may be spaced apart from an inner surface of the second leg 148 of the second support 114 by a distance of Ds and the first leg 146 of the second support 114 may be spaced apart from an inner surface of the second leg 148 of the second support 114 may a distance of Ds.

In the second position, illustrated in FIG. 6B, the anchoring members 150, 152 may be received into the respective anchoring features 202, 206, 208, 212 and the movement extensions 188 may be received into their respective stopper features 204, 210. Although the first legs 146 may be spaced apart by the spacing distance Ds from the second legs 148, the rotation members 154 may have a sufficiently long length (e.g., at least longer than the spacing distance Ds), to remain received within the pivoting apertures 142. In some embodiments, the rotation member 154 may be configured to have a length that may be approximately equal to the spacing distance Ds plus the width of the first leg 146, so that the rotation member 154 may be substantially flush with the left side surface 176 of the first leg 146 when received into the pivoting aperture 142. In this manner, the supports 112, 114 may remain connected together, despite the spacing distance Ds between the two legs 146, 148 of the supports 112, 114.

Once the supports 112, 114 have been separated by the spacing distance Ds, the keycap 108 may be operably connected to the supports 112, 114. The keycap 108, which may be operably connected to the cross member 168 at the recesses 160, 162, may secure the spacing distance Ds so that the supports 112, 114 may be secured in place. That is, prior to the keycap 108 being connected to the supports 112, 114 the supports 112, 114 may be movable laterally relative to each other and the keycap 108 may substantially prevent the supports 112, 114 from moving inwards or outwards relative to each other once connected. In this manner, the keycap 108 may also function as a spacing mechanism for the supports 112, 114 to secure them in position to maintain the spacing distance Ds between each other.

With reference to FIGS. 6A and 6B, the translation mechanism 110 may not require the supports 112, 114 to be deformed in order to be operably connected to the base 134. This may allow the supports 112, 114 to be made of a substantially or at least partially rigid material, such as a metal or metal alloy. Conventional scissor mechanisms for keyboards are typically made of plastic or other relatively easily deformable materials because typically the scissor mechanism may snap-fit into a securing member of the base or otherwise require deformation to be installed. As discussed above, the plastic or other relatively easily deformable materials may not transmit force equally across a key. This means that a key including a plastic scissor mechanism may have a different movement motion if a force is applied to a corner of the key versus a center of the key. For example, if a force is applied to an edge of the keycap, the edge of the keycap may move downwards, but the rest of the key may remain somewhat in place. In contrast, as the supports 112, 114 of the present disclosure may be a rigid or substantially rigid material, as a force is applied to activate a certain portion of the translation mechanism 110, the supports 112, 114 may respond in a same manner, regardless of the location of the force. Further, a force applied to an edge of the keycap 108 may be transmitted by the supports 112, 114 to a center and/or opposite edge of the keycap 108.

With reference to FIGS. 3A and 4A, the vertical motion of the key 106 will now be discussed in more detail. As a user provides a force to the keycap 108, the supports 112, 114 will move vertically downwards towards the base 134. Due to the rigidity of the supports 112, 114 and receipt of the rotation members 154 in the pivoting apertures 142, when the user provides a force on an edge of the keycap 108 or in the center of the keycap 108, the supports 112, 114 will move vertically in substantially the same manner. In other words, as a portion of one of the supports 112, 114 moves downwards, the entire support 112, 114 may also move, since the material may be sufficiently rigid to resist deformation and/or torqueing. Likewise, the structural stiffness and configuration of they keycap 108 may prevent a key from being depressed only on a corner or edge in response to an off-center force.

Because the anchoring members 150, 152 are substantially prevented (by the anchoring features 202, 206, 208, 212) from moving laterally along the base 134, the movement of the supports 112, 114 may be substantially vertical in translating between the extended and compressed positions of the keycap 108. Conventional scissor mechanisms may move laterally along the base, and so the keyboard may have to be dimensioned so as to accommodate vertical and lateral movement along the base.

As the keycap 108 is pressed, a bottom surface of the keycap 108 may reach the switch device 116, which may then cause the switch device 116 to at least partially compress as the supports 112, 114 move downwards. The switch device 116 may then provide input to the switch plate 118 indicating that the key 106 was selected and/or may provide feedback to the user. In other embodiments, the switch device 116 may be omitted and/or a separate activation mechanism may be operably connected to the keycap 108 to be activated when the keycap 106 moves vertically downward.

Alternative Embodiments of the Translation Mechanism

Figure 7A:
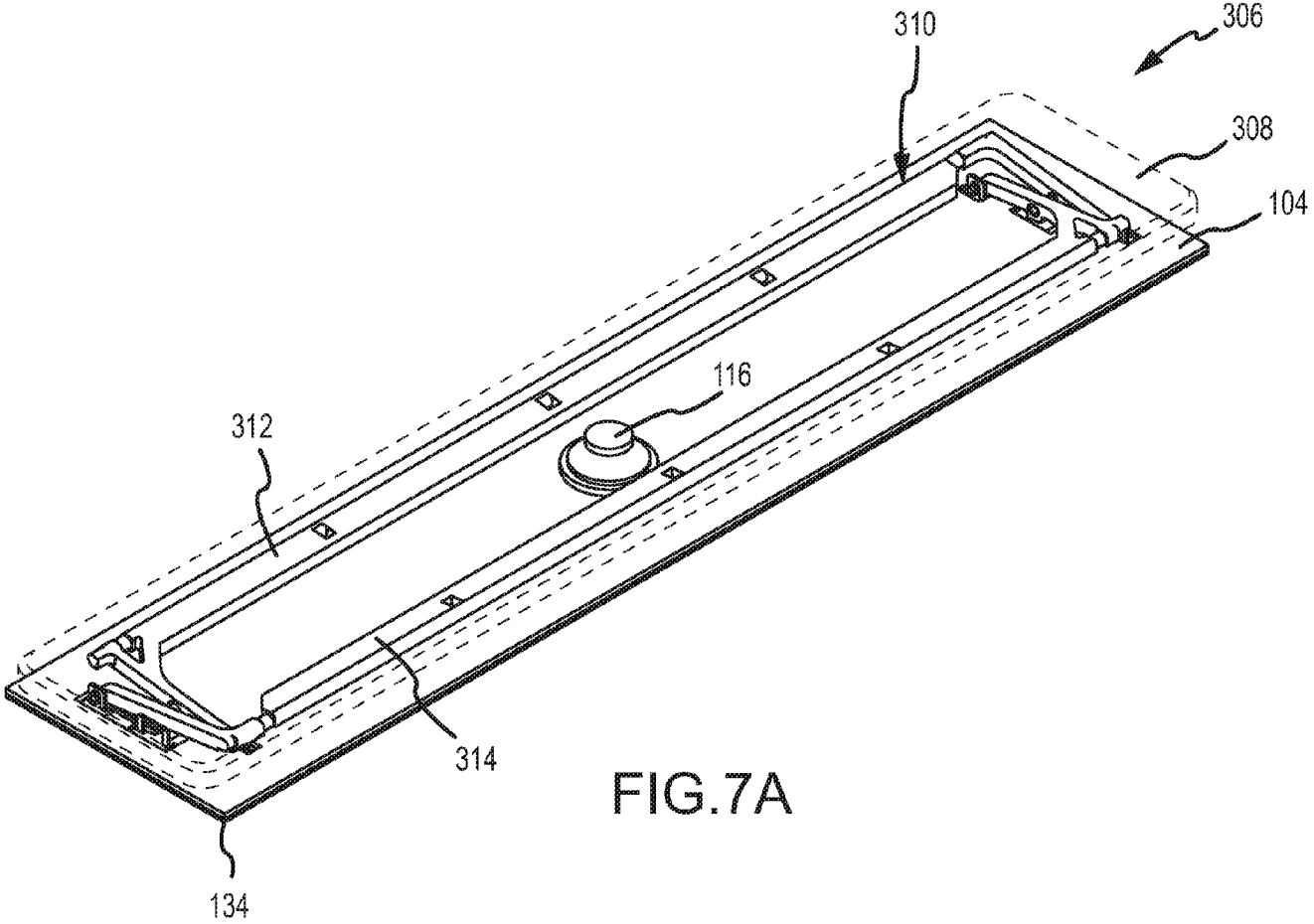
FIG. 7A is a top perspective view of another example of a key of the keyboard in an extended position with the keycap shown in phantom for clarity.
Figure 7B:
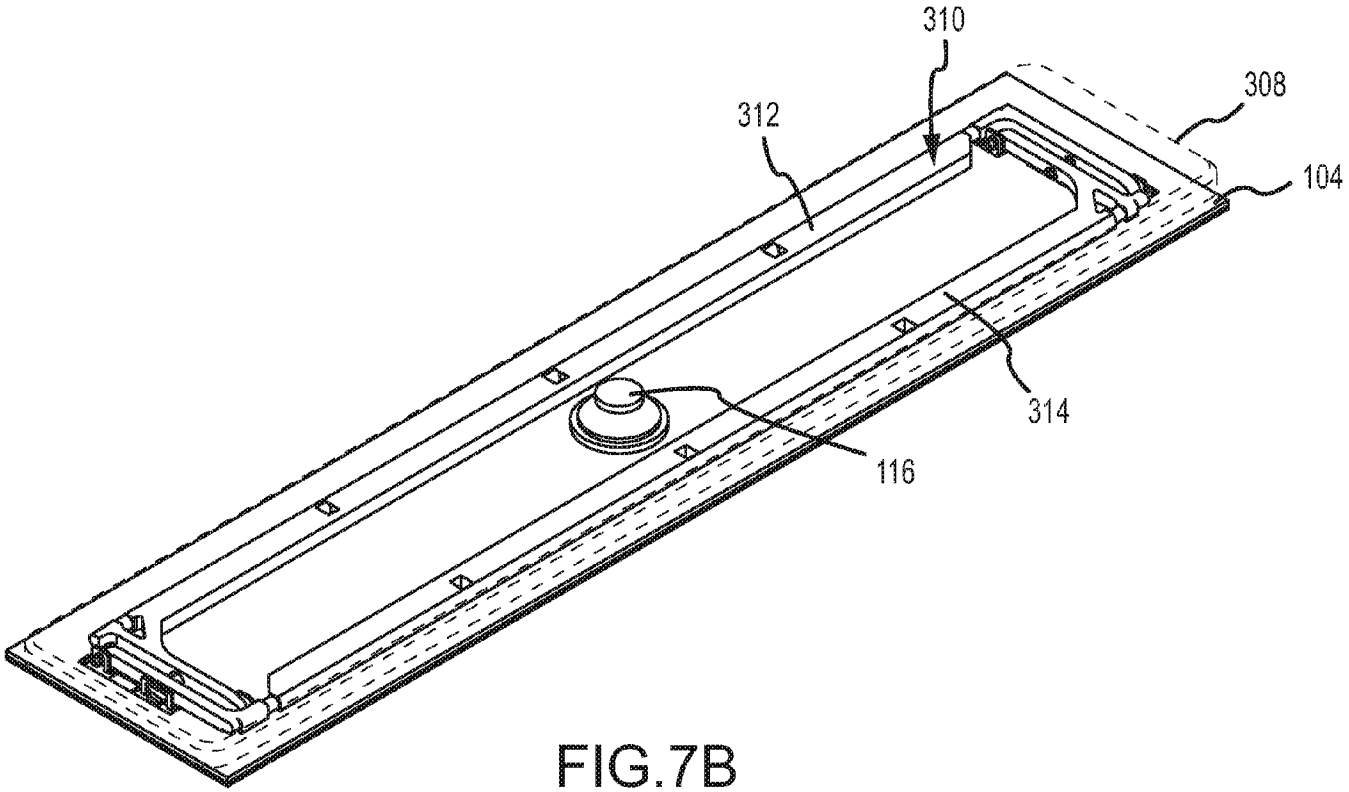
FIG. 7B is a top perspective view of the key of FIG. 7A with the key in a compressed position with the keycap shown in phantom for clarity.
Figure 8:
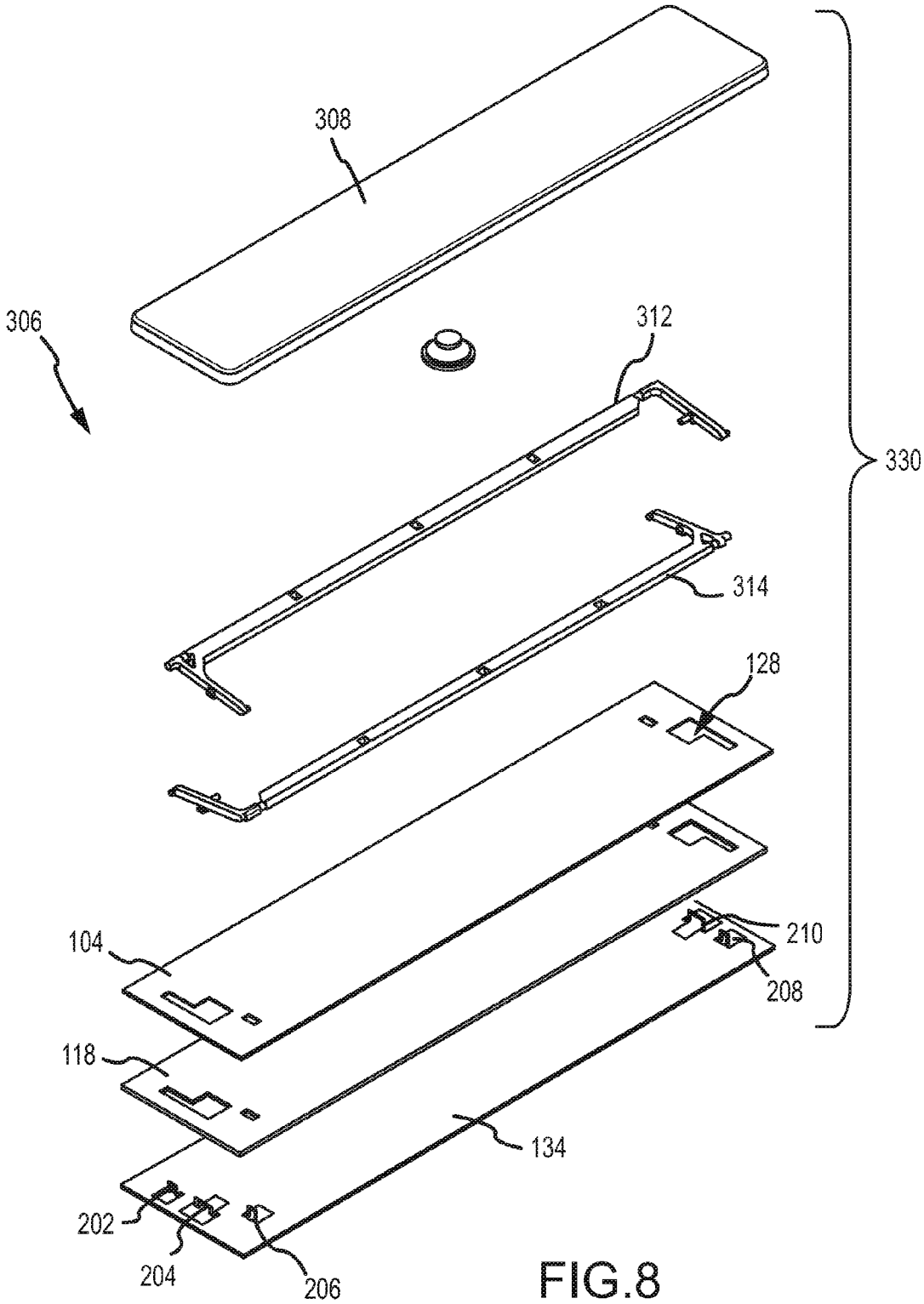
FIG. 8 is an exploded view of a the key of FIG. 7A.

The translation mechanism 110 may be used in differently sized and/or shaped keys 106 in addition to the configuration shown in FIG. 3A. FIG. 7A is a top isometric view of a key 306 that may be larger and/or longer than key 106, the key 306 of FIG. 7A may include the translation mechanism 110. FIG. 7B is a top perspective view of the key 306 in a compressed or selected position. FIG. 8 is an exploded view of the key 306. The key 306 of FIGS. 7A-8 may be a space bar, shift key, enter key, or may otherwise have an increased length and/or width from the key 102. The key 306 may be substantially similar to the key 106, but may have an increased length, width, shape, and/or orientation.

The key 306 may include a translation mechanism 310, which may be similar to the translation mechanism 110; however, in this embodiment, the supports 312, 314 may include an elongated portion that may extend substantially the entire length of the key 306. The key 306 may include the switch device 116, a portion of the enclosure 104, the feature plate 118, and/or the base 134.

The key 306 may also include a keycap 308 and the translation mechanism 310. These two components 308, 310 may be similar to their respective components in the embodiment illustrated in FIG. 2. However, the keycap 308 and the translation mechanism 310 may be extended in length so as to extend the entire length of the key 306. Additionally, in some embodiments, the keycap 308 and/or translation mechanism 310 may be appropriately modified to accommodate differently shaped keys. For example, in some embodiments it may be desirable to include steps or curves in the shape of the keys, and in these instances the keycap 308 and/or the translation mechanism 310 may be modified to include these features.

Figure 9:
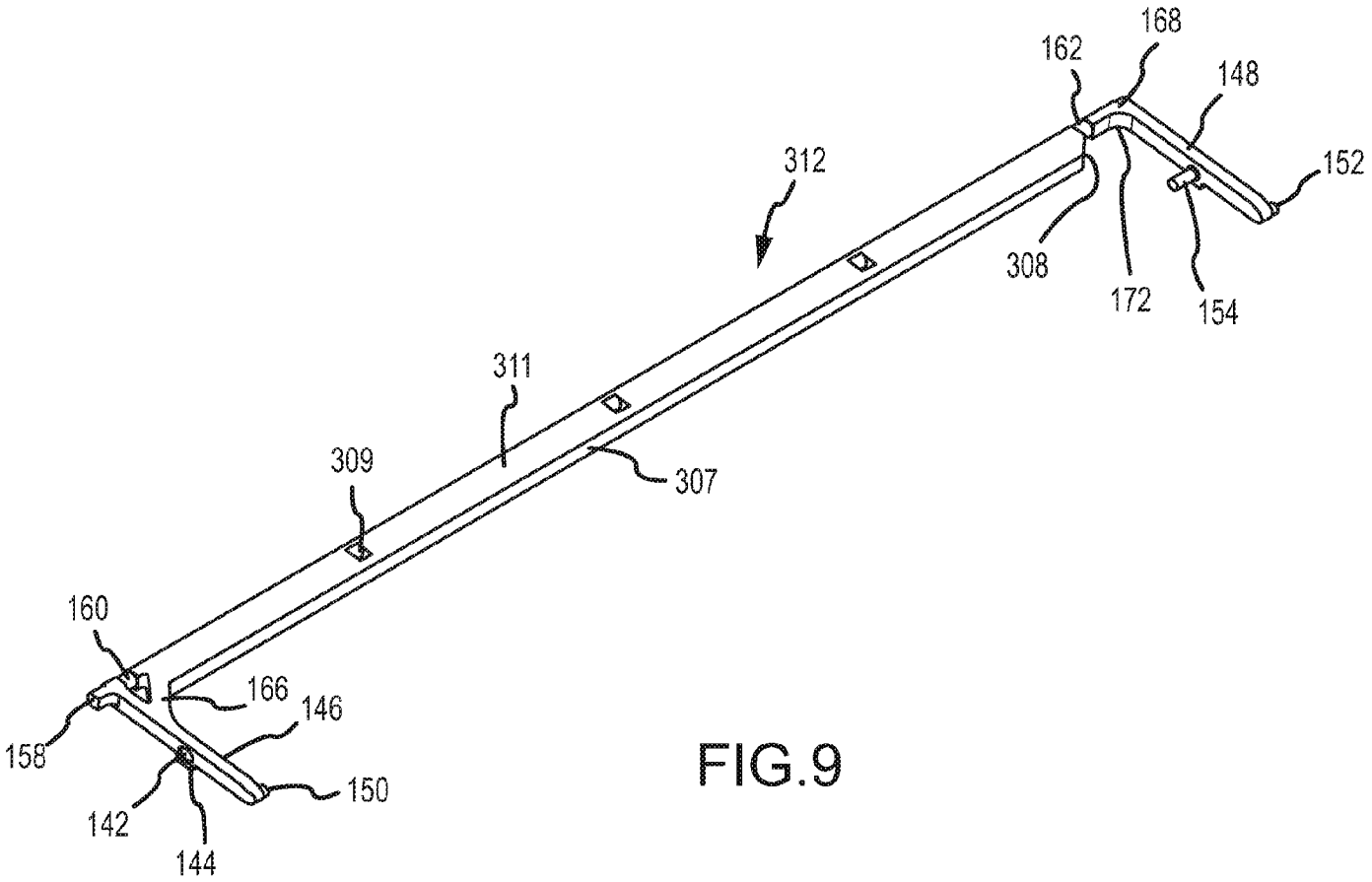
FIG. 9 is a top perspective view of a support for the key of FIG. 7A.
Figure 10:
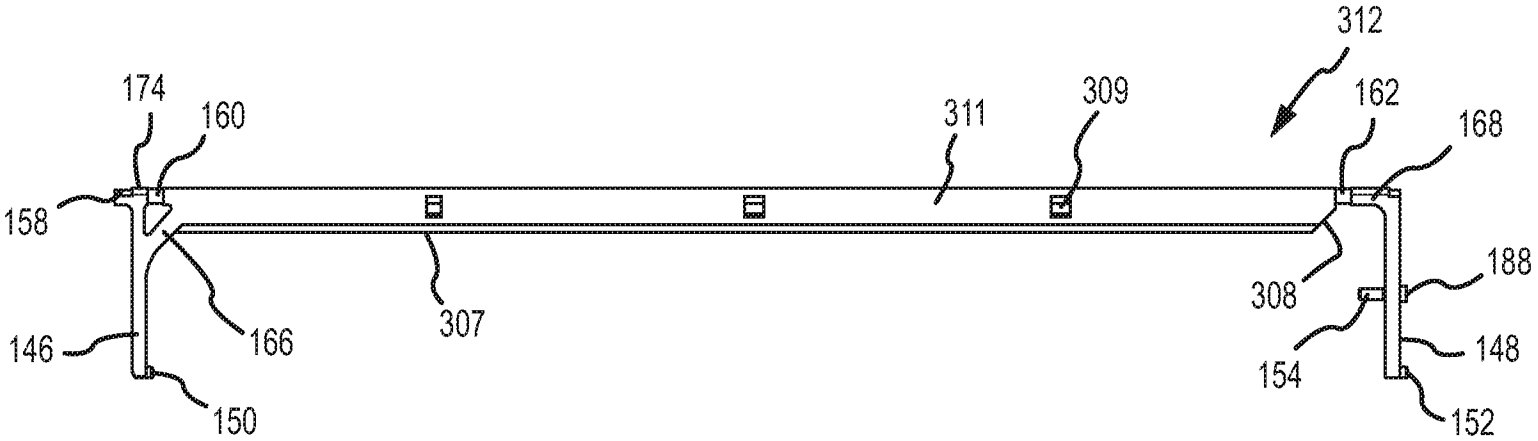
FIG. 10 is a top elevation view of the support of FIG. 9.

The translation mechanism 310 may include a first support 312 and a second support 314. The two supports 312, 314 may be similar to the supports 112, 114 and features not specifically discussed may be the same as with the supports 112, 114. FIG. 9 is a top isometric view of the first support 312. FIG. 10 is a top plan view of the first support 314. It should be noted that in some embodiments the first support 314 and the second support 314 may be substantially identical. The supports 312, 314 may be integrally formed members or may be formed of components operably connected together. The supports 312, 314 may be an at least partially rigid material, such as metal or a metal alloy, that may be sufficient to resist deflecting under force.

With reference to FIGS. 9 and 10, each support 312, 314 may include an elongated portion 311 that may extend between two ends of the cross-member 168 in order to extend the distance between the first leg 146 and the second leg 148. In some embodiments, the elongated portion 311 may have a larger width than the cross-member 168, which may better support the extra length of the keycap 308. The elongated portion 311 may extend from two adjacent ends of the cross-member 168 between the two recesses 160, 162 and in some embodiments, the shoulder 166 may extend from the first leg 146 to intersect with the elongated portion 311 rather than the cross-member 168. It should be noted that in some embodiments, the cross-member 168 may extend the entire length of the keycap 308 and so the elongated portion 311 may be omitted in these embodiments. In other embodiments, the legs 146, 148 may extend from the ends of the elongated portion 311 and the cross-member 168 may be omitted.

The elongated portion 311 may be integrally formed with the cross-member 168 and legs 146, 148 or may be separately connected thereto. The elongated portion 311 may include one more securing apertures 309 that may be spaced across its length. The securing apertures 309 may be used to connect the keycap to the supports. For example, the keycap 308 may include one or more portions (not shown) that may be received into the securing apertures 309 in order to operably connect the keycap 308 to the elongated portion 311. The elongated portion 311 may further include a beveled edge 308 adjacent a connection location to the second recess 162. The beveled edge 308 may provide a better transition from the thicker elongated portion 311 to the cross-member 168. For example, in some embodiments, the elongated portion 311 may have a larger cross-section than the cross-member 168 to provide additional strength to engage the keycap 308 along a length of the keycap 308, and the beveled edge 308 may enhance the transition from the larger cross section to a smaller cross section.

Along with the recesses 160, 162, the elongated portion 311 may connect to a bottom surface of the keycap 308. For example, as described above, the recesses 160, 162 may be snap-fit into securing features on the keycap or may be secured in other manners (e.g., by adhesives or other fasteners). Similarly, the elongated portion 311 may be snap-fit into a corresponding feature on the keycap 308 or may be otherwise connected to the keycap 308.

With reference again to FIGS. 7A and 7B, as a force is applied to the keycap 308, the two supports 312, 314 may translate vertically downwards towards the base 134. The rotation members 154 may pivot within the pivoting apertures 142, and may move laterally and/or vertically within the pivoting apertures 142 to allow the supports 112, 114 to move vertically. The anchoring members 150, 152 may be secured to the anchoring features 202, 206, 208, 210, which may substantially prevent the supports 312, 314 from moving laterally along the base 134 as they transition from the normal or extended position shown in FIG. 7A to the compressed position shown in FIG. 7B.

Since the supports 312, 314 are a substantially rigid material, the vertical movement of the keycap 308 may be substantially the same along the length of the keycap 308. For example, if the user compresses a first edge to the keycap 308 near the first leg 146, the second leg 148 of the other support may move at substantially the same time downwards and at the same rate of movement. In this manner, the user may press on substantially any location of the keycap 308 and the keycap 308 may have substantially the same vertical movement. In other words, the force-displacement characteristics for the key 306 may be substantially the same, regardless of the location of the force on the keycap 308. This may allow the key 306 to have reduced likelihood of bending due to a user input force, as compared to conventional keys. Less bending in the keycap 308 may provide for a reduced height for the keyboard 102 because the vertical travel distance of the keycap 308 may not have to accommodate for additional height due to an edge of the keycaps bending or otherwise experiencing torque to cause deformation or bending.

The supports 312, 314 and the elongated portion 311 may also provide support for the entire keycap 308 without the need for a linking bar. Conventional scissor mechanisms for keyboards that may be made out of non-rigid, flexible, or deformable materials may require metal linking bars for long keys, such as the spacebar or enter key. The linking bars are typically required in order to transfer a load that may be applied to an edge of the keycap to the center, where a dome or other input device may be located so that the device can be activated. These linking bars may increase the manufacturing complexity and costs of conventional keyboards, as an additional component has to be connected to the keyboard Also, linking bars may also create noise as a user applies a force to the keys, as they may be positioned between the scissor mechanism and the keycap and may vibrate or move while the key is compressed.

In contrast, the supports 312, 314 and elongated portion 311 may be sufficiently rigid to support the entire length of the keycap 308 without the need for a linking bar. In this manner, the supports 312, 314 and elongated portion 311 may activate the key and transfer the force to the center of the key 306 (or whether the switch device 116 and/or activation mechanism may be located), without the need for a linking bar. The rigidity or stiffness of the supports 312, 314 and elongated portion 311 is sufficient to transfer the force across the key 306. Accordingly, the key 306 may be easier to manufacturer than conventional keys including linking bars and may be less noisy during use.

The foregoing description has broad application. For example, while examples disclosed herein may focus on a keyboard, it should be appreciated that the concepts disclosed herein may equally apply to other input devices. Similarly, although the various embodiments may be discussed with respect to the keyboard, any of the separate features of the keyboard may be used separately or integrated together. Accordingly, the discussion of any embodiment is meant only to be an example and is not intended to suggest that the scope of the disclosure, including the claims, is limited to these examples.

What is claimed is:

1. A keyboard for an electronic device comprising:
- a switch plate configured to be in communication with the electronic device;
- a base positioned below the switch plate;
- a keycap movably supported above the switch plate; and
- a translation mechanism operably connected to the base and the keycap and configured to translate the keycap vertically relative to the switch plate, the translation mechanism including
  - a first support including:
    - a first leg defining a first pivoting structure;
    - a first anchoring member on said first leg;
    - a second leg operably connected to the first leg;
    - a first movement extension on an outer surface of said second leg;
    - a rotation member on an inner surface of said second leg; and
  - a second support including:
    - a third leg defining a second pivoting aperture;
    - a second anchoring member on said third leg;
    - a fourth leg operably connected to said third leg;
    - a second movement extension on an outer surface of said fourth leg;
    - a rotation member on an inner surface of said fourth leg; and
    - wherein the first support and the second support pivot relative to each other to translate the keycap vertically with respect to the switch plate and the first and second movement extensions are operably connected to the base and limit upward vertical translation of the keycap with respect to the switch plate.

2. The keyboard of claim 1, wherein the first support and the second support are metal.

3. The keyboard of claim 1 wherein the first support and the second support are substantially prevented from moving laterally with respect to the base.

4. The keyboard of claim 1, wherein the base further comprises at least one anchoring feature configured to receive the first and second anchoring members.

5. The keyboard of claim 1, wherein the first rotation member is received within the second pivoting aperture and the second rotation member is received within the first pivoting aperture.

6. The keyboard of claim 1, wherein
- the first rotation member has a first rotation length dimension and the first pivoting aperture has a first pivoting length dimension; and
- the second rotation member has a second rotation length dimension and the second pivoting aperture has a second pivoting length dimension; wherein
- the first pivoting length dimension is larger than the second rotation length dimension; and
- the second pivoting length dimension is larger than the first rotation length dimension.

7. The keyboard of claim 1 wherein said second support is substantially identical to said first support.

8. A scissor mechanism for a keyboard comprising:
- a first support including
  - a first leg defining a first pivoting aperture;
  - a first anchoring member extending from a first end of the first leg;
  - a second leg operably connected to the first leg;

a first movement extension extending from an outer surface of the second leg;

a rotation member extending from an inner surface of the second leg; and a second support including a third leg defining a second pivoting aperture;

a second anchoring member extending from a first end of the third leg;

a fourth leg operably connected to the third leg;

a second movement extension extending from an outer surface of the fourth leg;

a rotation member extending from an inner surface of the fourth leg; and wherein the first support and the second support translate a keycap vertically with respect to a base and the first anchoring member and the second anchoring member substantially prevent the first support and the second support, respectively, from moving laterally with respect to the base and the first and second movement extensions are operably connected to the base and limit an upward vertical movement of the scissor mechanism relative to the base.

9. The scissor mechanism of claim 8, wherein the first support and the second support are substantially identical to each other.

10. The scissor mechanism of claim 8, wherein the first support and the second support are a substantially rigid material.

11. The scissor mechanism of claim 8, wherein the first support further includes a first cross-member spanning between the first leg and the second leg; and the second support further includes a second cross-member spanning between the third leg and the fourth leg.

12. The scissor mechanism of claim 11, wherein the first support further comprises a first bridge member extending between the first leg and the first cross-member; and the second support further comprises a second bridge member extending between the third leg and the second cross member.

13. The scissor mechanism of claim 8, wherein the rotation member of the first support is pivotably received within the second pivoting aperture of the second support; and the rotation member of the second support is pivotably received within the first pivoting aperture of the first support.

14. The scissor mechanism of claim 13, wherein the first pivoting aperture and the second pivoting aperture are substantially oval shaped; and the rotation member of the first support and the rotation member of the second support are substantially circular shaped.

15. The scissor mechanism of claim 8, wherein the first support further includes a third anchoring member extending from a first end of the second leg; and the second support further includes a fourth anchoring member extending from a first end of the fourth leg; wherein the third anchoring member and the fourth anchoring member substantially prevent the first support and the second support from moving laterally with respect to the base.

* * * * *